US006820353B2

(12) United States Patent
Oman et al.

(10) Patent No.: US 6,820,353 B2
(45) Date of Patent: Nov. 23, 2004

(54) PERFORMANCE SHOE MIDSOLE

(75) Inventors: James D. Oman, Rancho Santa Margarita, CA (US); Anthony N. Zentil, Trabuco Canyon, CA (US); James H. Jannard, Eastsound, WA (US); Carlos D. Reyes, Rancho Santa Margarita, CA (US)

(73) Assignee: Oakley, Inc., Foothill Ranch, CA (US)

( * ) Notice: Subject to any disclaimer, the term of this patent is extended or adjusted under 35 U.S.C. 154(b) by 24 days.

(21) Appl. No.: 10/207,650

(22) Filed: Jul. 26, 2002

(65) Prior Publication Data

US 2004/0016146 A1 Jan. 29, 2004

(51) Int. Cl.[7] ..... A43B 13/20
(52) U.S. Cl. ..... 36/29; 36/28
(58) Field of Search ..... 36/29, 3 B, 30 R, 36/28

(56) References Cited

U.S. PATENT DOCUMENTS 5,830,553 A * 11/1998 Huang ..... 36/29
5,839,208 A * 11/1998 Huang ..... 36/28
5,916,664 A * 6/1999 Rudy ..... 36/29
6,098,313 A * 8/2000 Skaja ..... 36/28
6,625,902 B2 * 9/2003 Yamamoto ..... 36/3 B
2002/0050077 A1 * 5/2002 Wang et al. ..... 36/28

* cited by examiner

*Primary Examiner*—Ted Kavanaugh
(74) *Attorney, Agent, or Firm*—Knobbe, Martens, Olson & Bear, LLP.

(57) ABSTRACT

Application-specific midsoles and method of designing midsoles are described herein. The midsole includes a plurality of cells that extend generally upward from a generally flat support structure and provide the ability to selectively attenuate the ground reaction forces that result when one engages in activities associated with the application for which the shoe midsole is designed. The midsole comprises a plurality of zones. The shock attenuation properties of each zone is determined by the geometry of the cells in the zone and material composition of the midsole.

12 Claims, 8 Drawing Sheets

PERFORMANCE SHOE MIDSOLE

BACKGROUND OF THE INVENTION

1. Field of the Invention

This present invention relates to footwear. More particularly, the present invention relates to midsoles designed to meet the performance requirements of different wearers and applications.

2. Description of the Related Art

Different activities, such as, for example, running, walking, basketball, and tennis, have different performance requirements. For example, runners are exposed to repeated pounding in their feet, legs, and back, as their feet come into contact with the ground. The repeated pounding results in the transmission of ground reaction forces to the feet and other parts of the anatomy, such as, for example, the knees, the hips, etc. Ground reaction forces are generally transmitted from the ground surface to the foot upon impact of the foot with the ground. Repeated exposure to ground reaction forces takes its toll on the human body, often times resulting in chronic injuries. In some instances, the injury is much more acute and occurs only after a short period of exposure to ground reaction forces.

Certain types of activities have particular performance requirements. For example, individuals engaged in cutting motions generally need more vertical stability (i.e. less compressibility) in the lateral forefoot region. Similarly, individuals engaged in activities that involve running need more vertical stability in the toe region to facilitate the toe-off phase of a typical gait. Consequently, it is desirable to design a shoe that reduces the effect of ground reaction forces transmitted to the wearer during the activities associated with an application without compromising the performance needs associated with the activities.

Manufacturers have experimented with various materials and designs with the goal of providing shock attenuation and energy absorption in the midsole of the shoe. The "one size fits all" approach used by a variety of prior shoe designs is often an inaccurate approach to addressing the shock attenuation needs of the wearer because people with the same shoe size may have markedly different physical characteristics, such as weight and distribution of weight. People with different physical characteristics frequently have different shock attenuation needs.

Therefore, there remains a need for midsole designs that allow the midsoles to selectively attenuate ground reaction forces by taking into consideration the physical characteristics of the people wearing the shoes and the performance requirements of the applications for which the shoes are worn. Notwithstanding the variety of prior shoe designs, there remains a need for shoe midsoles that provide the appropriate amount of shock attenuation in the appropriate areas of the feet to individuals engaged in particular types of activities.

SUMMARY OF THE INVENTION

The present invention provides for a shoe midsole with zones designed to meet the performance requirements of a given activity. The present invention also comprises a method for designing a shoe midsole to meet the performance requirements of a specific application.

In one embodiment, the shoe midsole comprises a support structure, a plurality of cells, and a plurality of midsole zones that are designed to provide specific targeted vertical deceleration levels.

In one embodiment, at least one of the midsole zones comprises a performance zone and at least one of the midsole zones comprises a comfort zone, wherein each performance zone has a targeted vertical deceleration level higher than that for each comfort zone, and wherein at least some of the cells within each performance zone have angles of drafting less than at least some of those in each comfort zone.

In one embodiment, the midsole zones that are designed to provide relatively lower targeted vertical deceleration levels comprise a plurality of cells that have relatively higher angles of drafting.

In one approach, a method of designing shoe midsoles comprises: selecting the application for which the shoes will be worn; determining the vertical stability requirements of the application; generating pressure distribution maps for each activity associated with the application; delineating zones on the midsole based on the vertical stability requirements and the pressure distribution maps; determining the targeted vertical deceleration level of each zone based on the vertical stability requirements and the pressure distribution maps; and selecting and varying the geometric and material properties of each zone to the extent necessary through an iterative process to achieve the targeted vertical deceleration level in each zone.

In one approach, the iterative process comprises: measuring the actual vertical deceleration level; comparing the actual and targeted vertical deceleration levels; adjusting the geometric and/or material properties within each zone as needed based on the difference between the actual and targeted vertical deceleration levels; and repeating the process until the actual and targeted vertical deceleration levels are the same.

BRIEF DESCRIPTION OF THE DRAWINGS

These and other features of the invention will now be described with reference to the drawings, which are intended to illustrate and not to limit the invention.

DETAILED DESCRIPTION

The present invention disclosed herein provides for a shoe midsole with zones designed to meet the performance requirements of a given activity, and is designed to meet the shock attenuation requirements of individuals engaged in a selected activity. The present invention also comprises a method for designing a shoe midsole to meet the performance requirements of a specific application, such as, for example, a particular type of sport.

As used herein, "anterior" means the front of the person wearing the shoes described herein. "Posterior" means the back of the wearer's body. "Medial" means toward the medial plane or vertical axis of the wearer's body, whereas "lateral" means away from the median plane or vertical axis of the wearer's body.

Many sports involve running, jumping, and cutting motions, all of which can place considerable amounts of pressure on the feet. Because ground reaction forces are transmitted to an individual when the individual's feet make contact with the ground, it is desirable from a design standpoint to attenuate ground reaction forces before they reach and pass through the feet. The magnitude and location of the ground reaction forces transmitted to the feet depend on the types of activities the individual is engaged in and the physical characteristics of the individual, such as, for example, body weight, ratio of body weight to shoe size, etc. Described herein is a midsole designed to selectively dissipate the vertical component of ground reaction forces to provide the appropriate amount of shock attenuation in the appropriate areas of the feet.

Figure 1A:
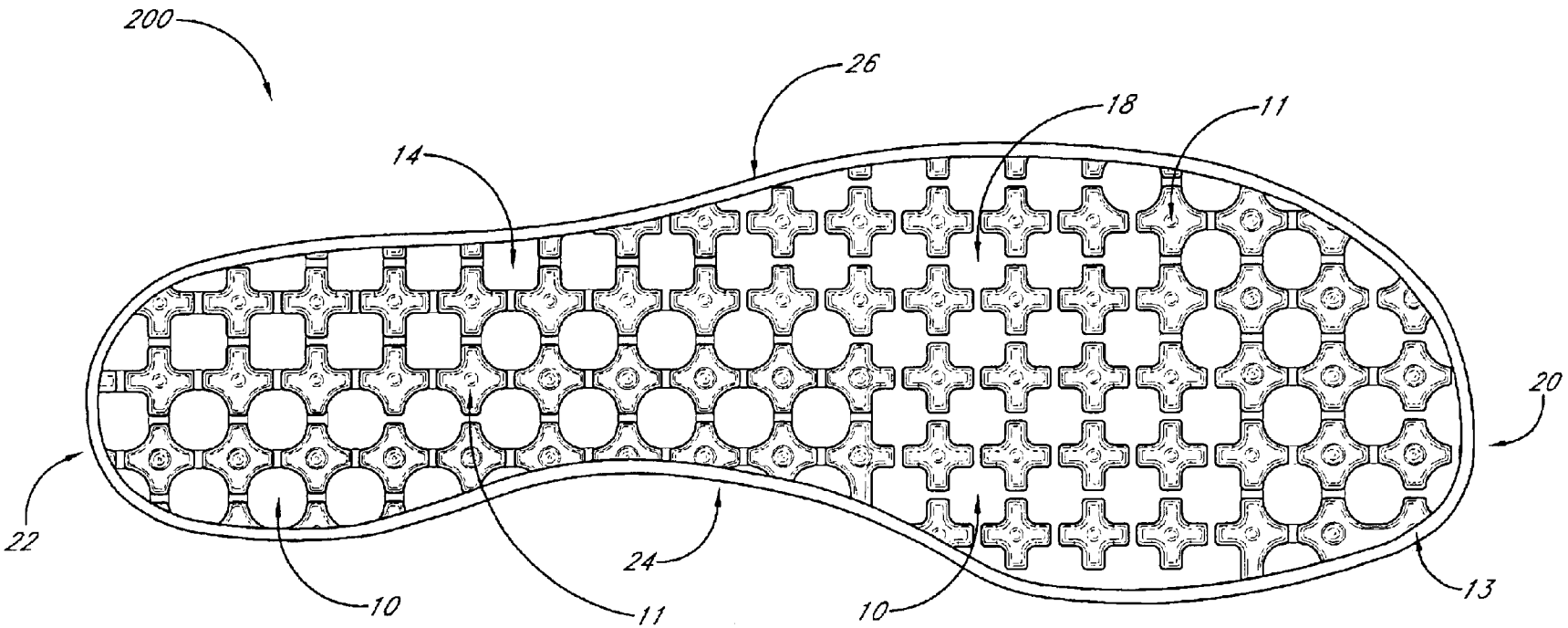
FIG. 1A is a top plan view of a shoe midsole for the left foot incorporating aspects of the present invention.
Figure 1B:
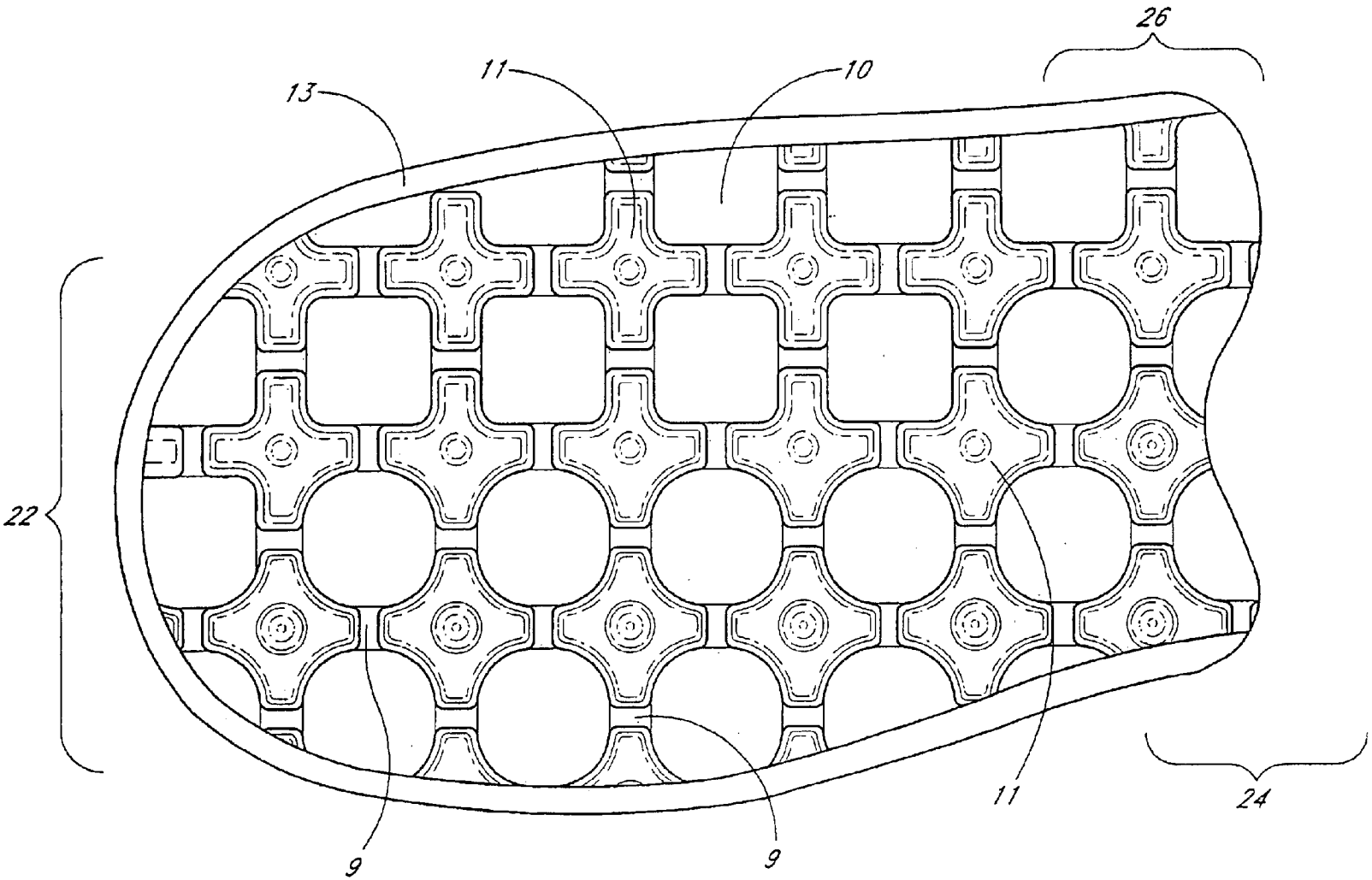
FIG. 1B is a close-up view of the heel region of the midsole in FIG. 1A.

The present invention comprises a midsole designed to selectively attenuate the ground reaction forces associated with various activities, such as, for example, basketball. With reference to FIGS. 1A and 1B, one embodiment of the present invention comprises a midsole 200 having a support structure 14 and a plurality of cavities 10 defined by a plurality of cross-shaped cells 11. As shown in FIGS. 1A and 1B, the cells 11 are separated from adjacent cells by grooves 9. A peripheral boundary 13 defines the outer perimeter of the midsole 200. The peripheral boundary 13 follows a predetermined contour that is selected to conform with the overall shape of the foot.

The midsole 200 has an anterior end 20 at the front or toe portion of the wearer's foot and a posterior end 22 at the rear or heal portion of the wearer's foot. The midsole 200 has a contoured medial side 24 and a contoured lateral side 26 opposed thereto. In the embodiment of FIGS. 1A and 1B, the midsole 200 is configured to support the left foot of the wearer. A midsole configured to support the right foot would be a mirror image of the midsole shown in FIG. 1A. For simplicity, only one midsole of a pair will be described in detail herein.

Cells 11 extend generally upward from the support structure 14 and are distributed throughout the midsole area 18 defined by the support structure 14 and peripheral boundary 13. In the embodiment of FIGS. 1A and 1B, the cells 11 have a cross-shaped geometry when viewed from the top of the midsole. In other embodiments, the cells 11 may be configured in one of any number of shapes, such as, for example, X-shapes, diamond shapes, circles, triangles, squares, U-shapes, V-shapes, etc. The cells 11 define the geometry of the cavities 10. Cells 11 of midsole 200 need not be uniform in cross-section, and may be varied geometrically by thickness, symmetry, and angle of drafting, as described in further detail below. The geometrical variations of the cells in each of the zones determine, in part, the shock attenuation properties of each of the zones, also explained in further detail below.

Figure 2:
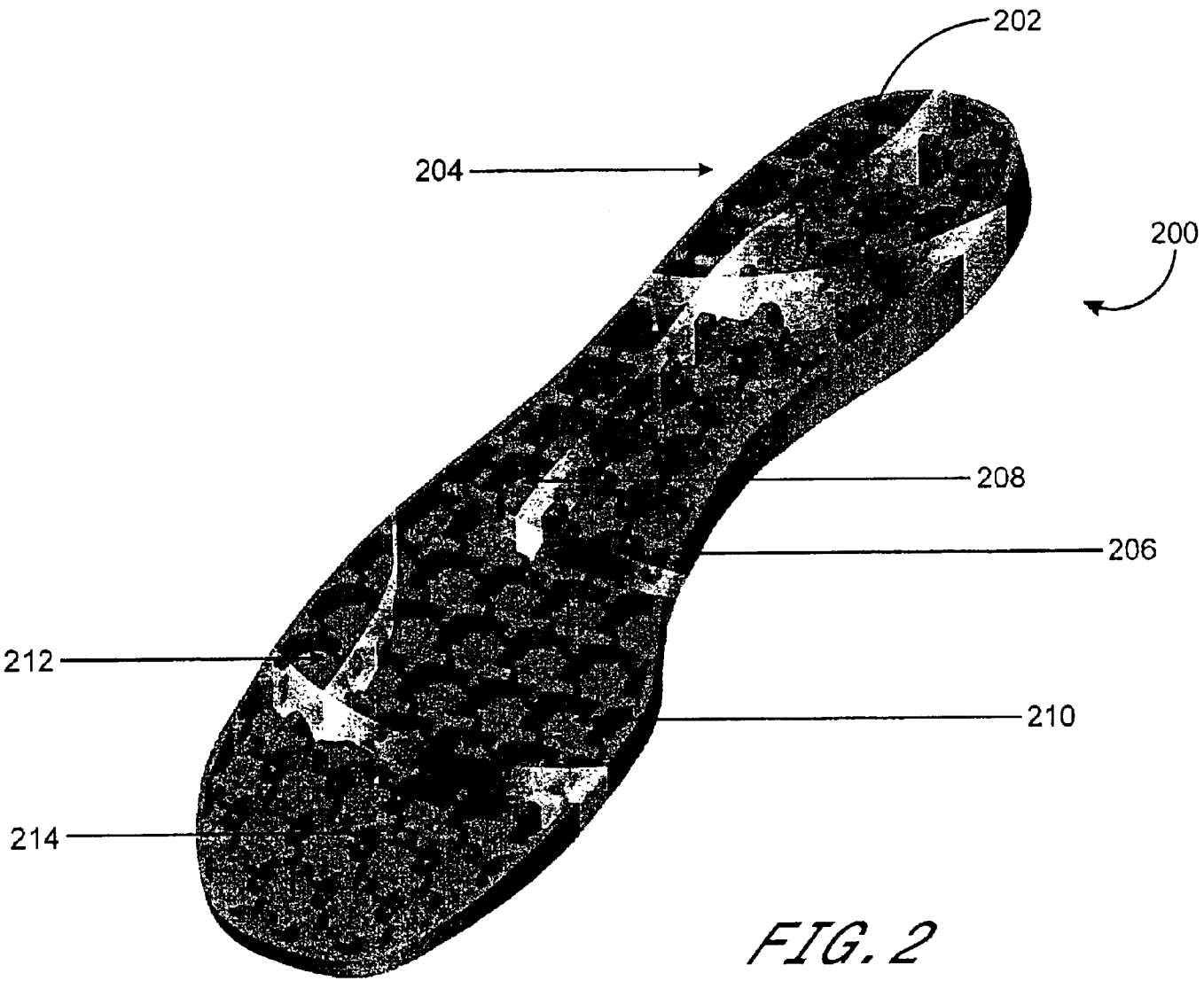
FIG. 2 is an isometric view of a shoe midsole for the right foot that is delineated into seven zones.

Zones are delineated on the upper surface of the midsole 200 by grouping together regions of the foot that are contiguous with each other and that share similar vertical stability or shock attenuation requirements. With reference to FIG. 2, one embodiment of midsole 200 designed for a basketball shoe has seven zones: the medial heel-to-midfoot zone 202; the lateral heel-to-midfoot zone 204; the medial mid-to-forefoot zone 206; the lateral mid-to-forefoot zone 208; the medial forefoot zone 210; the lateral forefoot zone 212; and the forefoot-to-phalanges zone 214.

The medial and lateral heel-to-midfoot zones 202 and 204 are designed primarily to attenuate ground reaction forces resulting from heel strike. The medial mid-to-forefoot zone 206 is designed primarily to provide medial transitional stability. The lateral mid-to-forefoot zone 208 is designed primarily to provide lateral transitional stability. The medial forefoot zone 210 is designed primarily to attenuate ground reaction forces resulting from jump landing activities. The lateral forefoot zone 212 is designed primarily to provide vertical stability, particularly when the wearer engages in cutting motions. The forefoot-to-phalanges zone 214 is designed primarily to provide vertical stability so that the wearer can propel him or herself forward during the toe-off phase of the his or her gait. It should be noted that the midsole shown in FIG. 2 is exemplary and that other embodiments of the midsole can have different numbers of zones and/or differently delineated zones. By varying the number, geometry, and spacing of the cells 11 in each zone, the shock attenuation properties of each of the zones may be controlled, as explained in further detail below.

The inventive midsole described herein is the product of a design method that addresses the performance and shock attenuation needs of individuals engaged in particular types of activities. The design method generally comprises: (1) selecting the application for which the shoes will be worn; (2) generating pressure distribution maps for each activity associated with the application; (3) delineating zones on the midsole based on the vertical stability requirements and the pressure distribution maps; (4) determining the targeted vertical deceleration level of each zone based on the vertical stability requirements and the pressure distribution maps; and (5) selecting and varying one or more of the geometric and/or material properties of each zone through an iterative process to achieve the targeted vertical deceleration level in each zone.

In one approach of the present inventive method, the design of the performance tuned midsole begins with selecting the application for which the midsole will be worn. Usually there are various activities associated with a selected application. For example, basketball involves numerous activities, including, but not limited to, jumping, running, and cutting. Tennis, for example, involves running, jumping, and sliding. In one approach, involving the design of a midsole for a basketball shoe, dynamic pressure distribution maps are generated for an individual engaged in jumping, running, and cutting activities. The pressure distribution map data for each activity is then used to delineate the midsole zones and to determine the relative targeted vertical deceleration level of each zone.

A. Pressure Distribution Maps

A pressure distribution map ("PDM") is an image or illustration that shows the amount and distribution of pressure or force on the plantar surface of the foot. Various foot pressure measurement systems and devices may be used to generate PDMs. For example, any of the platform-based or in-shoe foot pressure measurement systems offered by Tekscan, Inc., including, but not limited to, MatScan® or F-Scan®, can be used to measure plantar pressures through the use of real-time, tactile sensing systems. In one approach, PDM data is generated by having a human subject engage in certain activities, such as, for example, running or jumping, on a platform-based pressure measurement system.

In another approach, PDM data is generated by having the subject engage in certain activities while wearing an in-shoe pressure measurement system.

Figure 3:
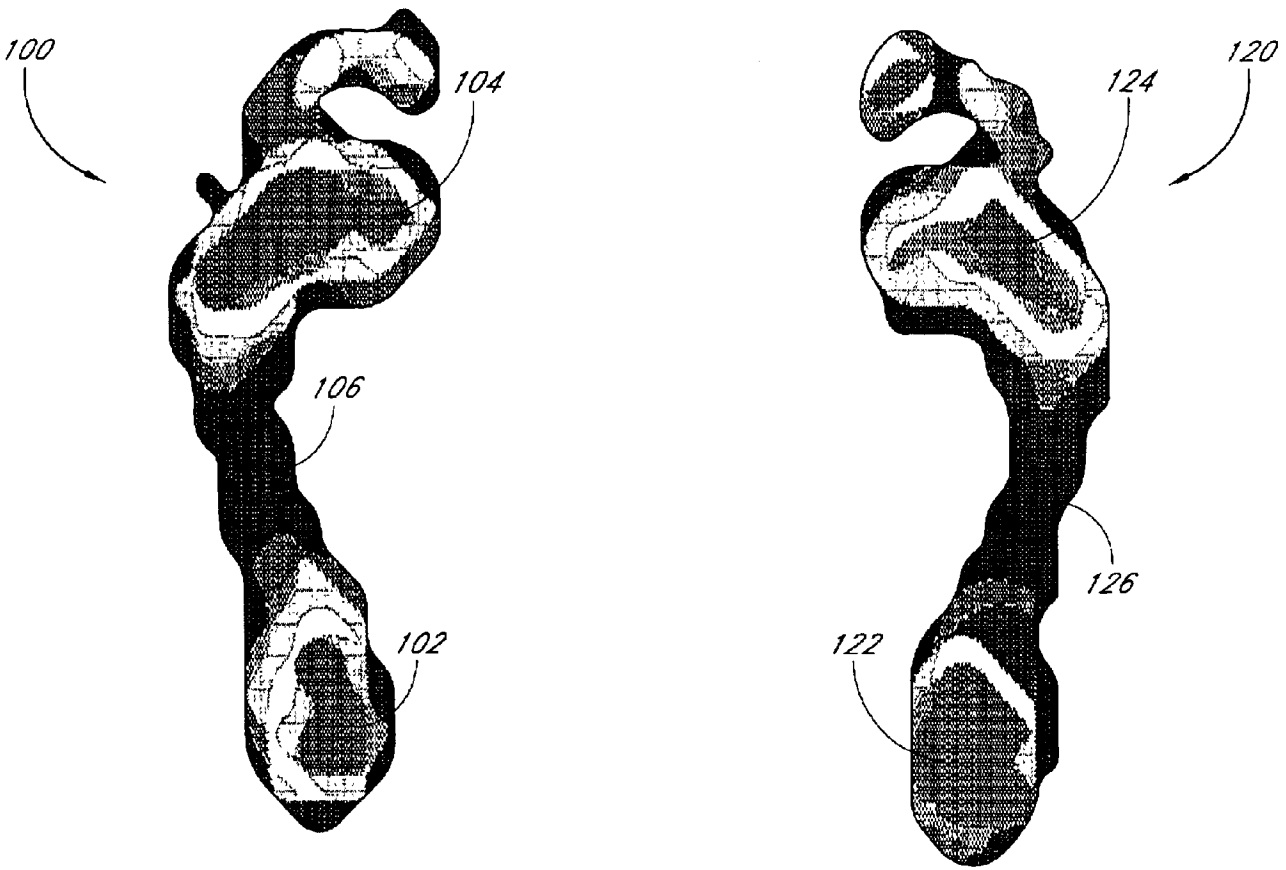
FIG. 3 is an example of a composite pressure distribution map of the left and right feet that can be used in the inventive method described herein.

A static PDM is a snapshot of the amount and distribution of pressure at a discrete point in time. A dynamic PDM is a sequential series of static PDMs recorded continuously over a period of time while a subject is engaged in a selected application or activity. FIG. 3 illustrates a composite PDM generated for an individual running on a pressure measurement platform. Each of the footprints 100 and 120 show pressure measurements on the plantar surface of the individual while the foot is in contact with the pressure measurement platform. The amount of pressure on the plantar surface of the foot is indicated by the color of the foot area. Depending upon the application, regions 102 and 122 correspond to areas near the heel 302 that absorb relatively high amounts of pressure when a subject runs along a pressure measurement platform. Regions 104 and 124 correspond to areas near the forefoot region 304 that also absorb relatively high amounts of pressure. Regions 106 and 126 correspond to regions near the middle portion of the foot that absorb relatively low amounts of pressure.

Any of the pressure mapping described herein can be generated for one or more subjects, depending on the specific design protocol. For example, in one approach, PDMs are generated for one subject if the midsole is being customized for an individual or if the subject's physical characteristics are representative of the group of people for whom the midsole is designed. In another embodiment, composite PDMs are generated for a group of subjects by normalizing and averaging the pressure data for each of the subjects. In another embodiment, composite PDMs are generated for a group of subjects by normalizing the pressure data and extracting the peak pressure values from each of the subjects for inclusion in the composite PDMs. In any embodiment that involves generating composite PDMs, the plantar pressure data is taken from the same foot—i.e. the right foot or the left foot.

In one approach, PDMs are generated by having the subject engage in an activity while barefoot or shoeless. In another approach, PDMs are generated by having the subject engage in an activity while wearing shoes. In yet another approach, PDMs are generated by having the subject engage in the same activity both with and without shoes. As will be explained in further detail below, by comparing the pressure and ground reaction force data in the PDMs generated with and without shoes, it is possible to gauge how much the shoes, and more particularly the midsoles, reduce the effects of ground reaction forces in the feet.

B. Delineation of Midsole Zones

Figure 4:
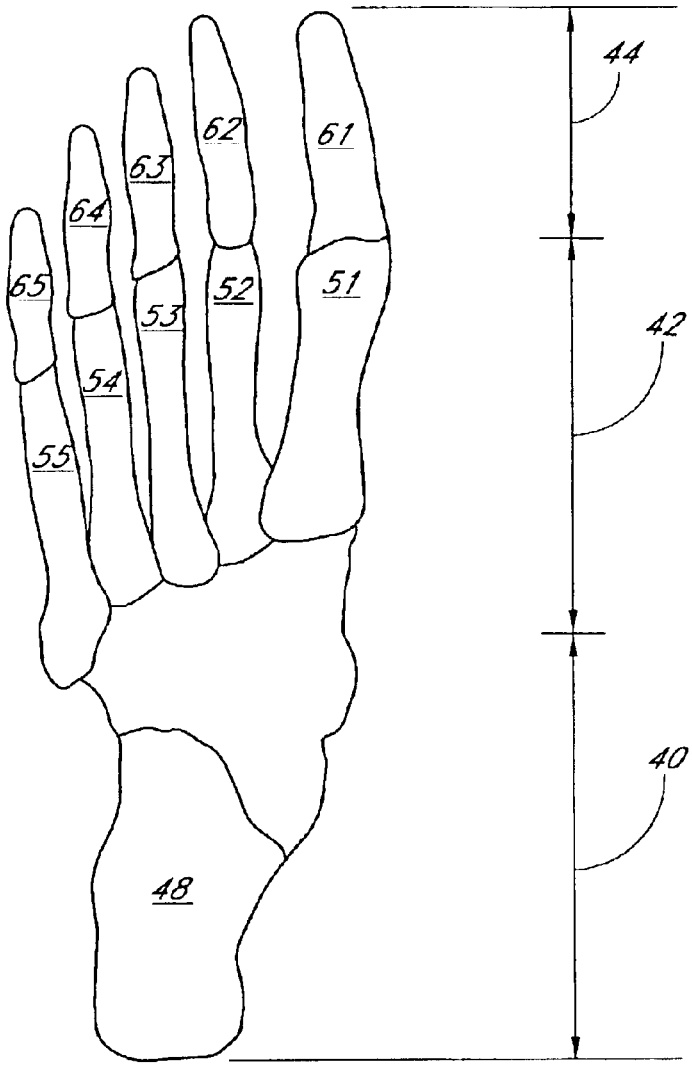
FIG. 4 is a plantar view of the bones of the left foot.

Based upon the PDM data generated, zones within the midsole area may be delineated. In delineating the zones of the midsole, it is advantageous to keep in mind the anatomy of the foot. The foot has numerous segmented bones that facilitate the ability of the foot to support body weight and propel the person forward and backward, side to side, up and down, and combinations thereof. With reference to FIG. 4, which illustrates the left foot, the foot 300 is characterized as having three primary regions: the tarsus 40, the metatarsus 42, and the phalanges 44. The tarsus 40 is the posterior or "heel" portion of the foot. The weight of the body is borne primarily by the calcaneous 48 of the tarsus 40. The metatarsus 42 is the middle portion of the foot and is made up of five bones called the metatarsals 51–55. The first metatarsal 51, located on the medial side of the foot, plays a major role in supporting the weight of the body. The phalanges 44 make up the anterior portion of the foot and correspond to the bones 61–65 of the toes. The great toe, represented as the phalanx 61 on the medial side of the foot, bears a large portion of the body weight and is the portion of the foot which pushes off of the ground during toe-off. The region where the distally located enlarged heads of the metatarsals 51–55 articulate with the proximally located phalanges 61–65 is referred to as the "ball" of the foot.

Figure 5:
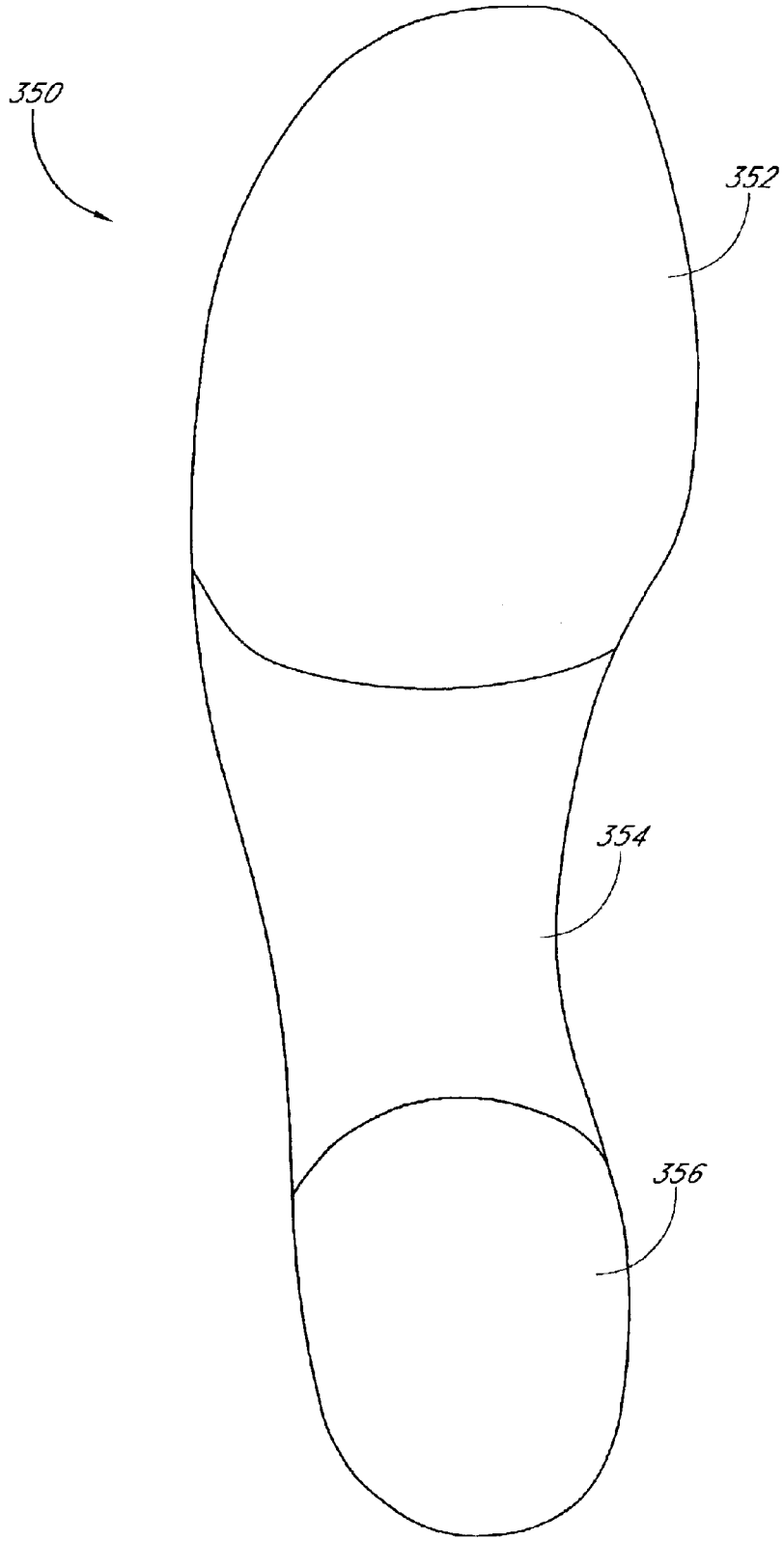
FIG. 5 is a top plan view of a shoe midsole for the left foot delineated into three zones.

In one approach of the present inventive method, illustrated in FIG. 5, the midsole 350 is initially delineated into three zones—namely, the anterior zone 352, the middle zone 354, and the posterior zone 356. Here, the anterior zone 352 corresponds to ball and toes of the foot. The posterior zone 356 corresponds to the heel of the foot. The middle zone 354 corresponds to the area of the foot in between the ball and heel of the foot. Experiments on human test subjects engaged in various activities, including, but not limited to, running, jumping, etc., have revealed that the heel and ball of the foot are frequently exposed to relatively high levels of ground reaction forces. Therefore, in one approach, one design goal is to provide sufficient shock attenuation in the regions of the midsole that correspond to the heel and ball of the foot. It should be noted that certain activities will require more shock attenuation in the heel and ball of the foot than others. For example, a midsole designed for a running shoe requires more shock attenuation in the heel and ball of the foot than a midsole in a cycling shoe. Nevertheless, the zones of the midsole are delineated with reference to the heel and ball of the foot because many activities, such as, for example, running, jumping, etc., frequently place tremendous pressure on these two regions.

In one approach, the anterior zone 352 is initially subdivided into a forefoot zone 210, which corresponds to the toe region of the foot, and a forefoot-to-phalanges zone 214, which corresponds to the ball region of the foot. That is because the toes can have different shock attenuation needs than the ball of the foot. For example, midsoles designed for running or basketball shoes should provide sufficient cushioning near the heel and ball of the foot, and yet be stiff enough in the toe region so that the great toe has a stable platform from which to push off of during running or jumping activities. As will be explained in further detail below, certain regions of the midsole are delineated based on the vertical stability requirements of the application and are designed to be provide more stiffness and resistance to compressibility.

In another approach, the anterior 352, middle 354, and posterior 356 zones in the midsole are each initially subdivided into medial and lateral zones, resulting in twice as many midsole zones. For certain types of applications, such as, for example, basketball, it is desirable to provide different levels of shock attenuation along the medial-lateral plane. For example, with reference to the midsole of basketball shoe illustrated in FIG. 2, in one embodiment, the lateral heel-to-midfoot zone 204 is designed to provide more shock attenuation than the medial heel-to-midfoot zone 202, resulting in more cushioning and compressibility on the lateral side of the heel region and more vertical stability on the medial side of the heel region.

Depending upon the results achieved, the initial delineations of midsole zones can be redefined based on the vertical stability requirements of the application and the PDM data so that contiguous regions of the midsole that have similar vertical stability or shock attenuation requirements are grouped together into the same zone. With regard to redefining the midsole delineations, there are two main categories of midsole zones: performance zones and comfort zones.

Performance zones refer to those midsole zones that are designed to provide resistance to vertical compression. Zones that are more resistant to vertical compression are generally stiffer and provide less shock attenuation, and vice versa. Certain applications require more vertical stability than others. For example, the toe region of a running shoe midsole and the lateral forefoot region of a basketball shoe midsole, both of which are explained in further detail below, both require more vertical stability. These regions are delineated into their own zones and referred to as performance zones. In some instances, performance zones are designed to provide relatively less shock attenuation even though these zones are exposed to relatively high levels of pressure or levels of pressure that are similar to that experienced by surrounding or neighboring regions of the midsole. Consequently, in one approach, the initial midsole zone delineations are redefined to include performance zones.

Comfort zones refer to those midsole zones that are designed to address the shock attenuation requirements of the application. In one approach, the shock attenuation requirements are based primarily on the PDM data. Contiguous regions of the plantar surface of the foot that are exposed to relatively high levels of pressure generally need more shock attenuation. Comfort zones are delineated to correspond to the contiguous areas of the foot that have similar shock attenuation requirements. In one approach, the comfort zones are delineated by changing the borderlines between each of the neighboring initial midsole zones without changing the total number of zones on the midsole. In another approach, the comfort zones are delineated by introducing new borderlines or removing initial borderlines, thereby increasing or decreasing the total number of zones. In yet another approach, the comfort zones are delineated by introducing or removing one or more borderlines while maintaining one or more of the initial borderlines.

The delineation of the performance and comfort zones depends, in part, on the degree of accuracy sought in providing the appropriate amount of vertical stability and shock attenuation in the appropriate regions of the foot. The method of midsole design described herein provides the ability to finely tune a midsole to meet the unique vertical stability and shock attenuation demands of a selected application. The design method described herein can also be used to custom design midsoles for one or more individuals who engage in the selected application.

C. Targeted Vertical Deceleration Level in the Midsole Zones

After the midsole zones have been delineated based on the vertical stability and shock attenuation requirements of the application, the next step is to determine the targeted vertical deceleration level for the midsole zones. Vertical deceleration refers to the rate at which a midsole zone attenuates ground reaction forces. As will be explained in further detail, low vertical deceleration translates into high shock attenuation, whereas high vertical deceleration translates into low shock attenuation. In one approach, a targeted vertical deceleration level ("TVD") is determined for each of the zones. In another approach, TVDs are determined for only a subset of the midsole zones.

As used herein, TVD has different meanings as applied to comfort zones and performance zones. As applied to comfort zones, TVD refers to the vertical deceleration level at which ground reaction forces are sufficiently attenuated to ensure comfort for the wearer. As applied to performance zones, TVD refers to the vertical deceleration level at which sufficient resistance to vertical compression is provided to meet the performance requirements of the application.

In one approach, PDM data is used to determine the TVDs for the comfort zones. One effect of the ground reaction forces that result when the foot makes contact with the ground during certain activities is increased pressure on the plantar surface of the foot. For any comfort zone, which has a fixed delineated area, the amount of pressure measured in the zone is proportional to the magnitude of ground reaction forces transmitted to the zone. Ground reaction forces can include vertical components ("vertical forces") and horizontal components ("horizontal forces").

A comfort zone with low vertical deceleration properties attenuates vertical forces by providing a soft surface that absorbs and/or redistributes a significant portion of the vertical forces transmitted to the zone over a relatively extended period of time, thereby providing a cushioning effect for the wearer. Low vertical deceleration, therefore, translates into relatively higher shock attenuation. In contrast, a comfort zone with relatively high vertical deceleration properties provides a more rapid response to vertical forces but attenuates a less significant portion of the vertical forces. Rapid deceleration translates into less absorption and/or redistribution of vertical forces by the comfort zone so that a higher percentage of the vertical forces are transmitted through the comfort zone. High vertical deceleration, therefore, translates into relatively lower shock attenuation.

The PDM data generated for each of the activities associated with an application can be processed in a number of different ways to determine TVDs for the comfort zones. In one approach, a representative pressure value ("RPV") is assigned to each of the comfort zones for a given activity associated with the application. In another approach, the RPV is the mean pressure within the comfort zone. In yet another approach, the RPV is the peak pressure value within the comfort zone. It will be noted that the RPV can be converted into representative ground reaction and/or vertical force values by taking into consideration the area of each comfort zone. For illustrative purposes, the discussion below will focus on calculations that use RPVs.

After RPVs are assigned to the comfort zones for each of the activities associated with the application, the activity-specific RPVs are further processed to calculate RPVs for the application. The application RPVs can be calculated in a number of different ways. In one approach, the application RPVs are the averages of the activity-specific RPVs. In another approach, the application RPVs are the peak pressure values of the activity-specific RPVs.

In another approach, application RPVs are determined by normalizing and superimposing the activity-specific PDMs so that the midsole zones line up with each other. The superimposed pressure readings in each of the comfort zones are further processed to calculate RPVs for the selected application. In one approach, the application RPV for each comfort zone is the average of the superimposed pressure values in the zone. In another approach, the application RPV for each comfort zone is the peak pressure value in the zone.

TVDs are assigned to each comfort zone based on the application RPVs for each comfort zone. In one approach, the application RPVs are converted into TVDs by using a computer-based algorithm that extrapolates and/or interpolates TVDs for input application RPVs based on the correlation between TVDs and application RPVs. The correlation between TVDs and application RPVs is based on known or historical data, such as for example, the guidelines provided by the footwear division of SATRA Technology Centre, an international consumer goods organization that provides standards and recommended testing procedures. For example, an acceptable vertical deceleration level according to the guidelines set forth by SATRA Test Method PM142 is 120–150 $m/s^2$ in the heel region of a size 9 shoe for an average male during normal running. In one approach, the computer-based algorithm is a neural network system. Training signals that include variables, such as, for example, application, body weight, gender, shoe size, acceptable TVDs, RPVs, etc., are fed into the neural network. In another approach, the neural network system provides or estimates TVDs for each comfort zone based on current input information, such as, for example, application RPVs, application, body weight, gender, shoe size, etc., as well as the historical data contained in the training signals fed into the neural network system.

There is generally an inverse correlation between the application RPVs and the TVDs in the comfort zones of the midsole. Comfort zones with relatively high application RPVs are assigned relatively lower TVDs, whereas comfort zones with relatively low RPVs are assigned relatively higher TVDs. With reference to FIG. 3, which shows a static PDM for an individual running on a pressure measurement platform, regions 102 and 122 near the heel experience relatively higher levels of pressure than regions 106 and 126 near the middle of the feet. In one approach, the midsole is designed to provide relatively lower vertical deceleration levels in regions 102 and 122. Similarly, regions 104 and 124 correspond to areas under the ball of the feet that absorb relatively high levels of pressure. In another approach, the midsole is designed to provide relatively lower vertical deceleration levels in regions 104 and 124.

In one approach, TVDs assigned to each comfort zone are quantified and expressed in the units of m/s2 or the like. In one approach, each of the quantified TVDs have an acceptable error range within which the actual vertical deceleration level of a given midsole zone should fall. In another approach, the TVDs of the midsole zones are quantified into ranges of acceptable values, expressed in units of m/s2 or the like, that are not defined in terms of error ranges surrounding a central or mean value. In yet another approach, the TVDs assigned to each comfort zone are not quantified into units of m/s2 or the like until prototype midsoles is constructed and tested on pressure measurements systems, such as, for example, MatScan®. Instead, the TVD of each zone is expressed in terms of the percentage difference between the initial RPV and the final RPV, as explained in further detail below.

In contrast to the comfort zones of the midsole, performance zones do not exhibit an inverse relationship between application RPVs and TVDs. This is because certain activities require more stability or stiffness (i.e. greater vertical deceleration level) in certain regions of the foot even if the PDMs and RPVs reveal that the region is exposed to relatively higher levels of pressure. For example, activities that involve running require more stability in the toe region, so that the great toe can push off of a relatively stiffer region of the midsole during toe-off motion. In one approach, the need for stability in the toe region is given greater import than the need to attenuate the effect of ground reaction forces transmitted to the toes. In one approach, the area of the midsole corresponding to the toe region is designed to provide more vertical deceleration than the area corresponding to the ball of the foot but less vertical deceleration than the midfoot area. In another approach, the area of the midsole corresponding to the toe region is designed to provide more vertical deceleration than the area corresponding to the ball of the foot and the same vertical deceleration as the midfoot area.

Activities which involve cutting motions, such as, for example, basketball, require greater stability in the front and lateral regions of the feet. In one approach, stability is achieved by providing relatively higher vertical deceleration properties in the front and lateral region of the foot. With reference to FIG. 4, which shows a midsole for a basketball shoe, the forefoot zone is delineated into a lateral forefoot zone 212 and a medial forefoot zone 210, with the lateral forefoot zone 212 providing higher deceleration than the medial forefoot zone 210. In one approach, the lateral portion of the forefoot region is designed with relatively higher vertical deceleration level even though the ground reaction forces transmitted to the lateral and medial portions of the forefoot are similar or the same in magnitude.

In one approach, the assignment of TVDs to the midsole zones begins with determining if the application for which the shoe containing the midsole is worn has unique stability requirements. The contiguous regions of the midsole which need to provide vertical stability to the wearer are delineated as one or more separate zones and designated as performance zones. Each of the performance zones are designed to have relatively higher vertical deceleration values. As with the TVDs assigned to the comfort zones, in one application, the application RPVs of the performance zones are converted into TVDs by using a computer-based algorithm which extrapolates and/or interpolates TVDs for input application RPVs based on the historical correlation between TVDs and application RPVs for performance zones. It will be noted that TVDs for performance zones are generally higher than the TVDs for comfort zones. As with the TVDs assigned to comfort zones, the TVDs assigned to performance zones can be quantified and expressed in units of $m/s^2$ or the like, or be expressed as the percentage difference between the initial RPV and the final RPV, as explained in further detail below.

Once TVDs are assigned to each of the midsole zones, one or more of the geometric and/or material properties of each of the zones are selected and adjusted to the extent necessary through an iterative process until the actual vertical deceleration level equals the TVD in each of the zones.

D. Physical Properties of Midsole Zones

The physical properties of each midsole zone include, but are not limited to, the material composition of the zone, the geometry, number, and distribution of cells on the upper surface of the support structure. In one approach, by selecting and adjusting the geometric properties of each of the midsole zones, the vertical deceleration level for each zone can be adjusted up and down until the TVD is achieved. The TVD is achieved through an iterative process of adjusting the geometric properties of the zone and conducting falling mass shock absorption tests and/or pressure measurement tests with a subject wearing a prototype midsole to measure the actual vertical deceleration of the zone.

Various suitable materials may be used in constructing the midsole. The midsole construction materials are preferably compressible and have elastic rebound characteristics. In one embodiment, plastic polymers, polyurethane foam, and/or ethylene vinyl acetate copolymers ("EVA") can be used make the midsole. Appropriate polyurethane materials for making the midsole include, but are not limited to, PDI RS1-20A, Dong Sung M6065, BAST Elastocell, Meramec Ultron, etc. In one embodiment, the same material is used throughout the entire midsole. In another embodiment, two or more materials are used in constructing the support structure and/or the cells of the midsole. In another embodiment, different materials are used to construct the different zones of the midsole.

One or more of the geometric and/or material properties of at least one of the zones is adjusted to the extent necessary through an iterative process until the actual (i.e. measured) vertical deceleration equals the TVD. It will be noted that the geometric and/or material properties are varied or adjusted if necessary to achieve the TVD in each zone. In some instances, it will not be necessary to adjust the geometric and/or material properties of a given zone if the initially selected properties achieve the TVD within the zone.

Figure 6:
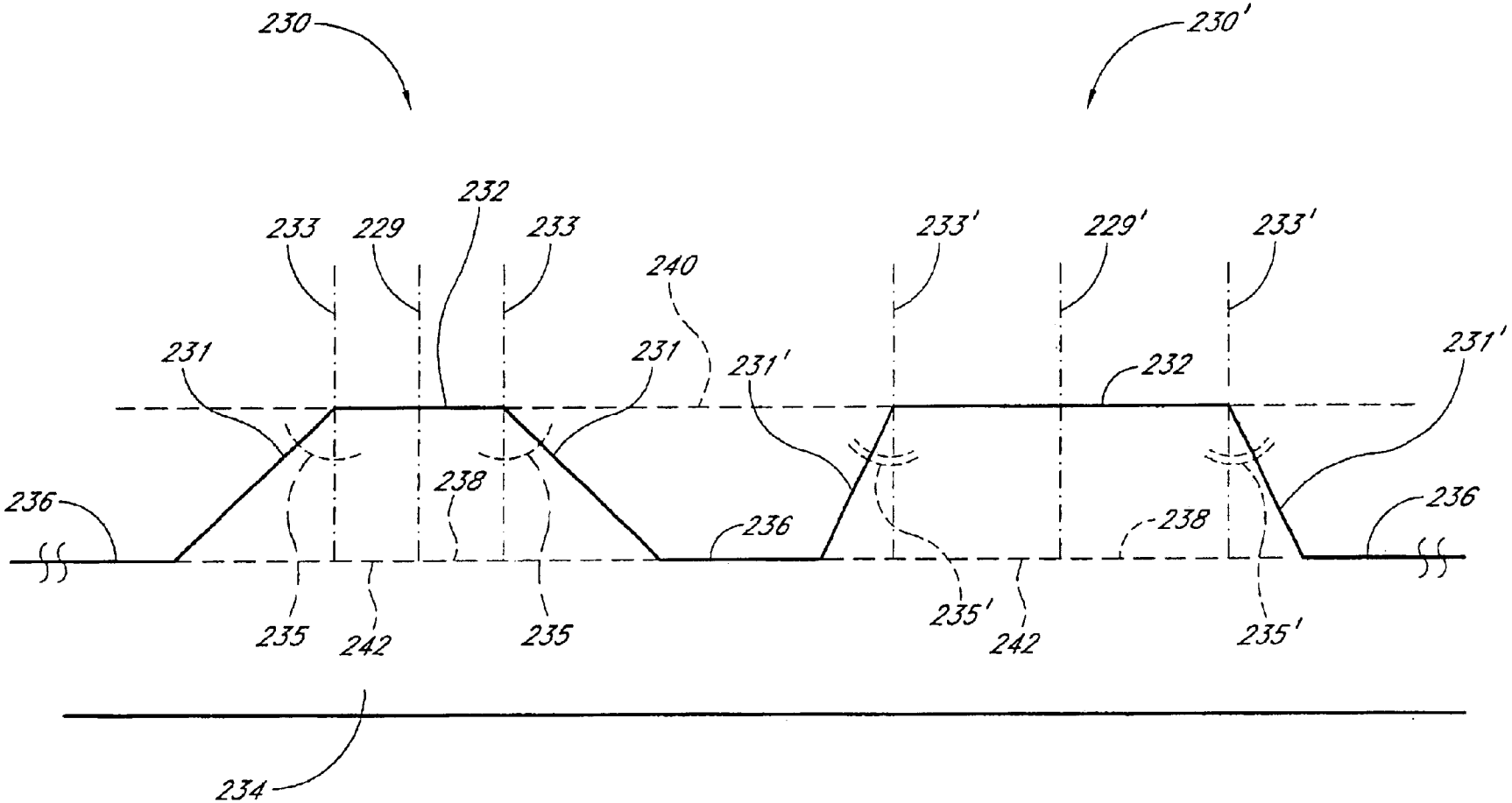
FIG. 6 is side view of two embodiments of cells on a shoe midsole.

As shown in FIGS. 1A, 1B, and 2, the structure of the midsole 200 includes a plurality of cells 11 that extend generally upward from a lower support structure 14. The cells 11 are distributed throughout the upper surface of the support structure 14. Geometric variables of the cells include, but are not limited to, size, shape, curvature, height, depth, angle of drafting, and cross-sectional thickness. Height refers to the height of the cell as measured from the support structure. Depth refers to the distance from the top of the cell to the support structure. With reference to FIG. 6, angle of drafting or degree of tapering 235, 235' refers to the angle in between the sides 231, 231' of the cells 230, 230' and the vertical axis 233, 233'. The cross-sectional thickness can be measured along the anterior-posterior axis or the medial-lateral axis.

With reference to FIG. 6, in one embodiment, the top surface area ("TSA" ) 232, 232' of each cell 230, 230' runs generally parallel with the upper surface 236, 236' of the support structure 234. Multiple horizontal cross-sections can be taken through each of the cells 230, 230'. In one embodiment, the top cross-section 240 is defined as the horizontal plane that runs parallel with the top surfaces 232, 232' of the cells 230, 230'. A second cross-section—namely, the bottom cross-section 242—is defined as the horizontal plane where the cells 230, 230' interface with the support structure 234. The areas inside the bottom cross-section 242 outlined by the perimeter of the cells 230, 230' are defined as the bottom surface areas ("BSA") 238, 238'.

Figure 7:
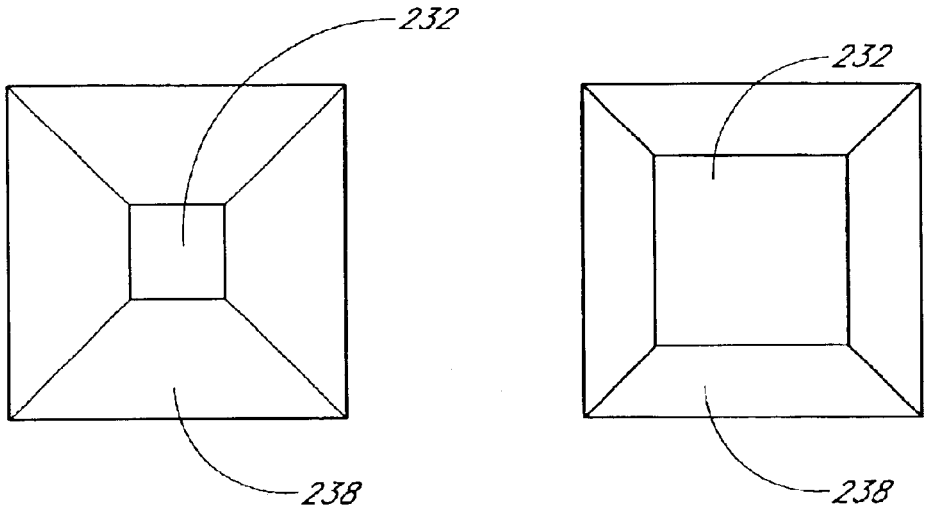
FIG. 7 is a top plan view of two embodiments of cells having square shapes.
Figure 8:
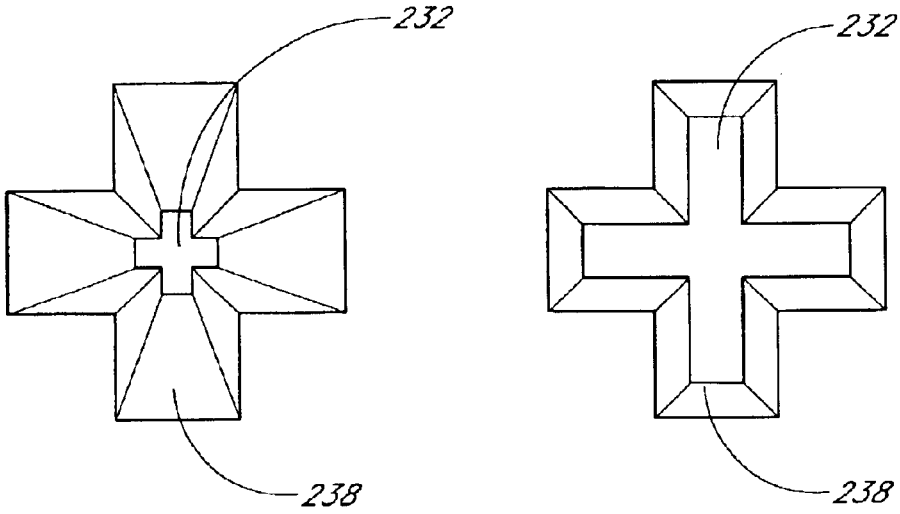
FIG. 8 is a top plan view of two embodiments of cells having cross shapes.

As the angle of drafting 235, 235' of any cell 230, 230' is increased, the ratio of TSA 232, 232' to BSA 238, 238' decreases (i.e. the value of TSA/BSA decreases as the degree of tapering 235, 235' increases). Conversely, the value of TSA/BSA increases as the angle of drafting 235, 235' decreases. With reference to FIG. 7, in one embodiment, the cell has a square shape. The ratio of TSA 232 to BSA 238 decreases as the angle of drafting 235 (not shown) is increased. With reference to FIG. 8, in one embodiment, the cell has a cross shape. Once again the ratio of TSA 232 to BSA 238 decreases as the degree of drafting 235 (not shown) is increased. In one embodiment, the angle of drafting 235 is varied while keeping the BSA 238 constant, such that the TSA 232 changes as the angle of drafting 235 is increased or decreased. In another embodiment, the angle of drafting 235 is varied while holding the TSA 232 constant, such that the BSA 238 changes as the angle of drafting 235 is varied.

With reference to the embodiments illustrated in FIGS. 6–8, it will be noted each of the cells 230 are generally symmetrical in geometry and shape relative to a visualized vertical axis 229, 229' that generally runs through the centers of the top and bottom surface areas 232, 238 of the cell 230, 230'. Consequently, the angle of drafting 235, 235' for any given cell will be the same, regardless which of which cell side wall 231, 231' of the cell 230, 230' is used to define the drafting angle 235, 235' relative to the visualized vertical axis 233, 233'. In contrast, FIGS. 1B and 1C show other embodiments in which the cells 11, 11' are not necessarily symmetrical in geometry and shape relative to the visualized central vertical axes. Here, the drafting angle measurement for any given cell 11, 11' depends on which side wall is used to define the drafting angle relative to the visualized vertical axis.

As long as all other physical properties within the midsole zone remain constant, a relatively lower TSA/BSA corresponds to a relatively lower vertical deceleration level, whereas a relatively higher TSA/BSA corresponds to a relatively higher vertical deceleration level. This is explained by the fact that resistance to compression is a function of horizontal cross-sectional area. Regions of the cells having relatively larger horizontal cross-sectional areas are able better able to resist compression caused by downward forces, thereby providing a relatively larger vertical deceleration. In contrast, regions having relatively smaller horizontal cross-sectional areas are more easily compressible, resulting in a relatively smaller vertical deceleration. Because cells with relatively lower TSA/BSA values have a greater proportion of regions with smaller horizontal cross-sectional areas, the upper regions of the cells will compress more easily, thereby resulting in relatively lower vertical deceleration. Similarly, cells with relatively higher TSA/BSA values have a smaller proportion of regions with smaller horizontal cross-sectional areas, the upper regions of the cells will compress less easily, thereby resulting in a relatively higher vertical deceleration level.

In one method of design, the angle of drafting for one or more of the cells within a midsole zone are increased in order to decrease the amount of vertical deceleration provided by the zone. In another method of design, the angle of drafting for one or more of the cells within a midsole zone are decreased in order to increase the amount of vertical deceleration provided by the zone. In addition to varying the geometric properties of the cells, it is also possible to change the amount of vertical deceleration provided by the zone by adjusting the number and distribution of cells. If one keeps all other physical properties of the cells within a midsole zone constant, those midsole regions with a relatively higher number or concentration of cells will generally provide more shock attenuation, and thereby decrease the amount of vertical deceleration provided by the zone. As one can see, the result of the present method of designing midsoles is a midsole with zones that are infinitely tunable to a desired vertical deceleration level.

E. Iterative Testing Process

Each midsole zone is preferably tuned to a TVD through an iterative process that involves: (1) selecting the starting geometric and material properties of each zone; (2) conducting a test to measure the actual vertical deceleration level in each zone; (3) varying the geometric and/or material properties of each zone as needed based on the difference between the targeted and actual vertical deceleration levels; and (4) repeating the process until the actual and targeted vertical deceleration levels are the same.

In one approach, where the TVD is expressed in the units of $m/s^2$ or the like, the actual vertical deceleration level of the zone is measured by running Test Method PM142, entitled "Falling Mass Shock Absorption Test" (May 1992), as published by the footwear division of SATRA Technology Centre. Test Method PM142 is applicable to bottom units of whole shoes and can be used to access any compressible sheet material such as those used for midsoles. An impact striker of a known fixed mass having a domed lower surface is dropped from a predetermined height onto the test material, such as, for example, the bottom unit of a shoe or a midsole. The maximum deceleration of the striker and indentation of the material are recorded during impact. The testing apparatus and methodology of Test Method PM142 is hereby incorporated by reference. Other appropriate testing devices and procedures known to one skilled in the art can be used in conjunction with or in lieu of Test Method PM142 to measure vertical declaration in the midsole zones.

In another approach, the TVD is expressed as the percentage difference between the initial and final RPVs, where the initial RPV is the application RPV calculated when the subject is barefoot or shoeless, and where the final RPV is the application RPV calculated when the subject is wearing shoes that contain the midsole constructed with the most recently selected or adjusted physical properties. The percentage difference between the initial and final RPVs is calculated as (initial RPV—final RPV)/(initial RPV)*100%. For midsole zones having TVDs quantified in this manner, the actual vertical deceleration level is determined by adjusting the physical properties as need and then calculating the percentage difference using the same equation described herein.

The physical properties of the midsole, such as, for example, the geometry of the cells, are varied as needed based on the difference between the actual and targeted vertical deceleration levels. In one approach, the angle of drafting is varied while keeping all other physical properties of the cells constant in order to achieve the TVD. If the actual vertical deceleration level were greater than the TVD, then the angle of drafting would be increased relative to the vertical axis to provide more shock attenuation. If the actual vertical deceleration level were less than the TVD, the angle of drafting would be decreased relative to the vertical axis to provide more vertical stability. The actual vertical deceleration level would then be measured and used to vary the physical properties of each midsole zone as needed until the actual (i.e. measured) vertical deceleration level in each zone equals the TVD for the zone.

Although the present invention is described herein primarily in the context of sports-related activities, the present invention has value in the design and production of footwear in general. Therefore, any reference herein to a sports-related activity should be construed as exemplary and not limiting. Any method described and illustrated herein is not limited to the exact sequence of acts described, nor is it necessarily limited to the practice of all of the acts set forth. Other sequences of events or acts, or less than all of the events, or simultaneous occurrence of the events, may be utilized in practicing the method(s) in question.

What is claimed is:

1. An application-specific shoe midsole, comprising:

a support structure along a bottom of the midsole comprising a generally flat foot-shaped lower portion having a peripheral boundary, wherein the lower portion comprises an upper surface and a lower surface;

a plurality of cells that extend generally upward from the upper surface of the lower portion, and at least one groove positioned between the cells, the cells comprising a top cross-section area and a bottom cross-section area; and a plurality of midsole zones, wherein at least one of the midsole zones comprises a performance zone and at least one of the midsole zones comprises a comfort zone, the performance zone comprising a first cell having a first bottom cross-section area that is at least as large as a corresponding first top cross-section area, the comfort zone comprising a second cell having a second bottom cross-section area that is at least as large as a corresponding second top cross-section area;

wherein the first cell has a top cross-section area to bottom cross-section ratio that is greater than that of the second cell; and wherein the performance zone has a vertical deceleration level higher than that for the comfort zone.

2. An application-specific shoe midsole, comprising:

a support structure along a bottom of the midsole comprising a generally flat foot-shaped lower portion having a peripheral boundary, wherein the lower portion comprises an upper surface and a lower surface;

a plurality of cells that extend generally upward from the upper surface of the lower portion, and at least one groove positioned between the cells, the cells comprising a top cross-section area and a bottom cross-section area; and a plurality of midsole zones, the midsole zones designed to provide higher vertical deceleration levels comprising one or more cells of a first type having bottom cross-section areas at least as large as corresponding top cross-section areas, the midsole zones designed to provide lower vertical deceleration levels comprising one or more cells of a second type having bottom cross-section areas at least as large as corresponding top cross-section areas;

wherein the first type of cells have top cross-section area to bottom cross-section area ratios that are greater than those of the second type of cells.

3. A shoe midsole, comprising:

a support structure along a bottom of the midsole comprising a generally flat foot-shaped lower portion having a peripheral boundary, wherein the lower portion comprises an upper surface and a lower surface;

a plurality of cells that extend generally upward from the upper surface of the lower portion, the cells comprising a top cross-section area and a bottom cross-section area; and a plurality of midsole zones, wherein at least one of the midsole zones comprises a performance zone and at least one of the midsole zones comprises a comfort zone, the performance zone comprising a first cell having a first bottom cross-section area that is at least as large as a corresponding first top cross-section area, the comfort zone comprising a second cell having a second bottom cross-section area that is at least as large as a corresponding second top cross-section area;

wherein the first cell has a top cross-section area to bottom cross-section area ratio that is greater than that of the second cell.

4. The midsole of claim 3, wherein the midsole regions that have higher vertical deceleration levels comprise a greater number of cells per a defined area as compared to the midsole regions that have lower vertical deceleration levels.

5. The midsole of claim 3, wherein the cells further comprise a cell side wall and an angle of drafting defined by the intersection of the cell side wall and a visualized vertical axis that is perpendicular to the cell top cross-section area.

6. The midsole of claim 1, wherein the first cell further comprises a first cell side wall and a first angle of drafting defined by the intersection of the first cell side wall and a first visualized vertical axis that is perpendicular to the first top cross-section area, and wherein the second cell further comprises a second cell side wall and a second angle of drafting defined by the intersection of the second cell side wall and a second visualized vertical axis that is perpendicular to the second top cross-section area.

7. The midsole of claim 6, wherein the first angle of drafting is less than the second angle of drafting.

8. The midsole of claim 1, wherein the top cross-section area of at least one cell comprises a top surface area of the at least one cell.

9. The midsole of claim 1, wherein the bottom cross-section area of at least one cell comprises a bottom surface area of the at least one cell.

10. The midsole of claim 3, wherein the top cross-section area of at least one cell comprises a top surface area of the at least one cell.

11. The midsole of claim 3, wherein the bottom cross-section area of at least one cell comprises a bottom surface area of the at least one cell.

12. The midsole of claim 5, wherein the midsole zones that are designed to provide relatively lower vertical deceleration levels each comprise at least one cell having an angle of drafting that is greater than those in the midsole zones that are designed to provide relatively greater vertical deceleration levels.

* * * * *

UNITED STATES PATENT AND TRADEMARK OFFICE

CERTIFICATE OF CORRECTION

PATENT NO. : 6,820,353 B2
APPLICATION NO. : 10/207650
DATED : November 23, 2004
INVENTOR(S) : Oman et al It is certified that error appears in the above-identified patent and that said Letters Patent is hereby corrected as shown below:

On title page

At line (56) of the cover sheet, insert -- 2,537,414 10/1950 Hallgren --;
-- 4,345,387 08/1982 Daswick --;
-- 4,715,130 12/1987 Scatena --;
-- 4,733,483 03/1988 Lin --;
-- 4,999,931 03/1991 Vermeulen --;
-- 5,035,068 07/1991 Biasi --;
-- 5,042,175 08/1991 Ronen et al. --;
-- 5,233,767 08/1993 Kramer --;
-- 5,315,769 05/1994 Barry et al. --;
-- 5,493,791 02/1996 Kramer --;
-- 5,517,770 05/1996 Martin et al. --;
-- 5,595,003 01/1997 Snow --;
-- 5,647,145 07/1997 Russell et al. --;
-- 5,651,196 07/1997 Hsieh --;

At Item (56) of the cover sheet, after 5,938,208 A * 11/1998 Huang……...36/28, insert -- 5,901,467 05/1999 Peterson et al. --;

At Item (56) of the cover sheet, after 5,916,664 A * 6/1999 Rudy ……...36/29, insert -- 6,029,962 02/2000 Shorten et al. --;
-- 6,061,928 05/2000 Nichols --;

At Item (56) of the cover sheet, after 6,098,313 A * 8/2000 Skaja……...36/28, insert -- 6,138,383 10/2000 Steinke et al. --;
-- 6,195,915 B1 03/2001 Russell --;
-- 6,253,466 A * 07/2001 Harmon-Weiss et al. --.

Signed and Sealed this

Fourth Day of March, 2008

JON W. DUDAS
*Director of the United States Patent and Trademark Office*